US009310073B2

(12) United States Patent
Buelow et al.

(10) Patent No.: US 9,310,073 B2
(45) Date of Patent: Apr. 12, 2016

(54) LIQUID SWIRLER FLOW CONTROL

(75) Inventors: Philip E. O. Buelow, West Des Moines, IA (US); Randall Duane Siders, Urbandale, IA (US); David H. Bretz, West Des Moines, IA (US); Neal A. Thomson, West Des Moines, IA (US)

(73) Assignee: Rolls-Royce plc (GB)

( * ) Notice: Subject to any disclaimer, the term of this patent is extended or adjusted under 35 U.S.C. 154(b) by 817 days.

(21) Appl. No.: 13/481,411

(22) Filed: May 25, 2012

(65) Prior Publication Data

US 2012/0228405 A1 Sep. 13, 2012

Related U.S. Application Data

(63) Continuation-in-part of application No. 12/932,958, filed on Mar. 10, 2011, and a continuation-in-part of application No. 13/368,659, filed on Feb. 8, 2012, now Pat. No. 9,228,741.

(51) Int. Cl.
*B05B 1/34* (2006.01)
*F02M 59/00* (2006.01)
(Continued)

(52) U.S. Cl.
CPC ..... *F23D 11/107* (2013.01); *F23R 3/28* (2013.01); *F23R 3/343* (2013.01); *F23D 2900/11101* (2013.01)

(58) Field of Classification Search
CPC .. F23R 3/28; F23R 3/343; F23D 2900/11101; F23D 11/107
USPC ..... 239/463, 13, 399, 403–406, 553, 382, 239/128, 533.2, 533.1; 60/740, 747, 748, 60/776, 804
See application file for complete search history.

(56) References Cited

U.S. PATENT DOCUMENTS 1,875,457 A * 9/1932 Hemmingsen ..... 239/132.5
4,422,426 A 12/1983 Tsugekawa et al.
(Continued)

FOREIGN PATENT DOCUMENTS

DE 1008068 B 5/1957
EP 1312866 A2 5/2003
(Continued)

OTHER PUBLICATIONS

European Extended Search Report for Application No. EP12250054 dated May 5, 2015, 5 pages.
(Continued)

*Primary Examiner* — Len Tran
*Assistant Examiner* — Steven M Cernoch
(74) *Attorney, Agent, or Firm* — Barnes & Thornburg LLP

(57) ABSTRACT

A flow directing device for imparting swirl on a fluid includes a flow directing body having a first surface and opposed second surface. A flow channel is defined in the first surface of the flow directing body for conducting fluids flowing through the flow directing body. The flow channel includes a channel surface set in from the first surface. A swirl bore extends though the flow directing body from the channel surface to the second surface of the flow directing body at an oblique angle relative to the channel surface for imparting a tangential swirl component onto fluids flowing through the swirl bore. Having an asymmetrical terminus portion of the channel surface, and positioning of the swirl bore within the terminus portion, allow control of the swirl direction for flow within the terminus portion and swirl bore.

4 Claims, 9 Drawing Sheets

(51) Int. Cl.

| | |
|---|---|
| ***F02M 61/00*** | (2006.01) |
| ***F02M 63/00*** | (2006.01) |
| ***F23D 11/10*** | (2006.01) |
| ***F23R 3/28*** | (2006.01) |
| ***F23R 3/34*** | (2006.01) |

(56) References Cited

U.S. PATENT DOCUMENTS

| | | | | |
|---|---|---|---|---|
| 4,601,428 | A * | 7/1986 | Kurogo | 239/427.3 |
| 4,756,508 | A * | 7/1988 | Giachino et al. | 251/331 |
| 4,957,239 | A * | 9/1990 | Tempelman | 239/117 |
| 4,982,716 | A * | 1/1991 | Takeda et al. | 123/531 |
| 5,054,691 | A * | 10/1991 | Huang et al. | 239/585.3 |
| 5,570,580 | A * | 11/1996 | Mains | 60/747 |
| 5,767,384 | A | 6/1998 | Wang et al. | |
| 6,240,732 | B1 * | 6/2001 | Allan | 60/739 |
| 6,523,350 | B1 * | 2/2003 | Mancini et al. | 60/740 |
| 6,547,163 | B1 * | 4/2003 | Mansour et al. | 239/404 |
| 6,622,488 | B2 * | 9/2003 | Mansour et al. | 60/740 |
| 6,672,066 | B2 * | 1/2004 | Wrubel et al. | 60/740 |
| 6,688,534 | B2 * | 2/2004 | Bretz | 239/8 |
| 6,718,770 | B2 * | 4/2004 | Laing et al. | 60/740 |
| 6,755,024 | B1 * | 6/2004 | Mao et al. | 60/776 |
| 6,898,938 | B2 * | 5/2005 | Mancini et al. | 60/748 |
| 7,028,483 | B2 * | 4/2006 | Mansour et al. | 60/748 |
| 7,506,510 | B2 * | 3/2009 | Thomson | 60/740 |
| 7,926,178 | B2 * | 4/2011 | Thomson et al. | 29/890.142 |
| 2003/0221429 | A1 * | 12/2003 | Laing et al. | 60/740 |
| 2004/0148937 | A1 * | 8/2004 | Mancini | 60/740 |
| 2004/0148938 | A1 * | 8/2004 | Mancini et al. | 60/740 |
| 2005/0087630 | A1 | 4/2005 | Sayar | |
| 2006/0059915 | A1 * | 3/2006 | Furletov et al. | 60/740 |
| 2007/0163263 | A1 | 7/2007 | Thomson | |
| 2009/0140073 | A1 | 6/2009 | Thomson et al. | |
| 2012/0227408 | A1 * | 9/2012 | Buelow et al. | 60/747 |
| 2012/0228397 | A1 * | 9/2012 | Thomson | 239/13 |

FOREIGN PATENT DOCUMENTS

| | | | |
|---|---|---|---|
| EP | 1471308 | A1 | 10/2004 |
| EP | 1512912 | A2 | 3/2005 |
| EP | 1750056 | A2 | 2/2007 |
| EP | 2017534 | A1 | 6/2009 |
| EP | 2169313 | A2 | 3/2010 |
| GB | 2374406 | A | 10/2002 |
| GB | 2404976 | A | 2/2005 |

OTHER PUBLICATIONS

Extended European Search Report for related European Patent Application No. 13169005.9-1605 / 2667098, search completed Sep. 23, 2015, 6 pages.

Extended European Search Report, European Application No. 12182739.8, completed Nov. 20, 2015, (9 pages).

* cited by examiner

Fig. 4
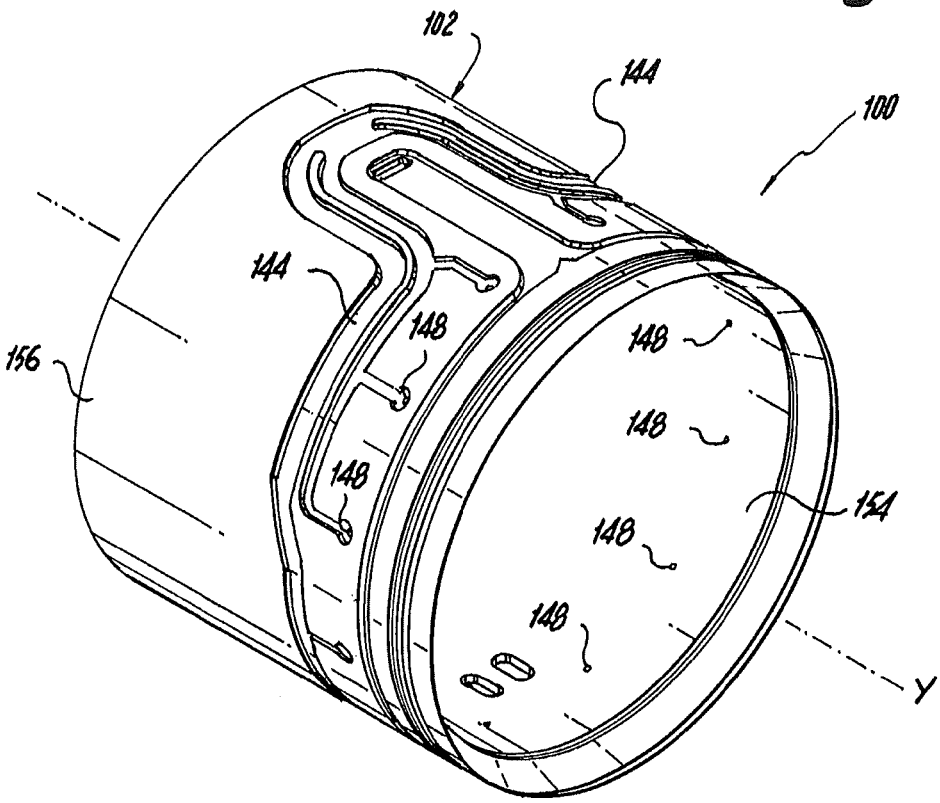
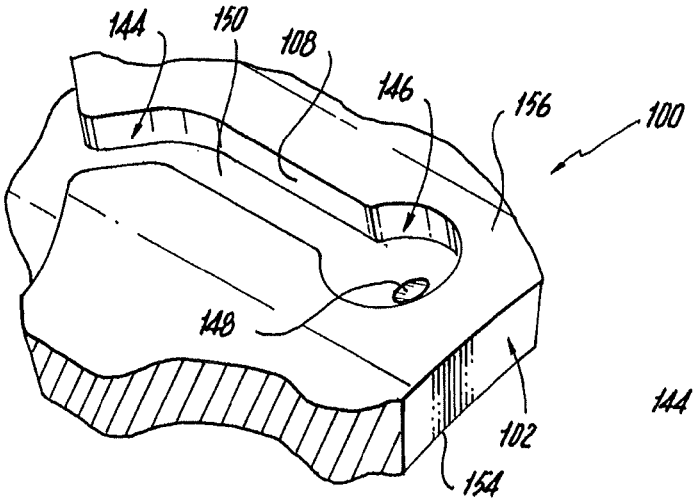
Fig. 5
Fig. 6
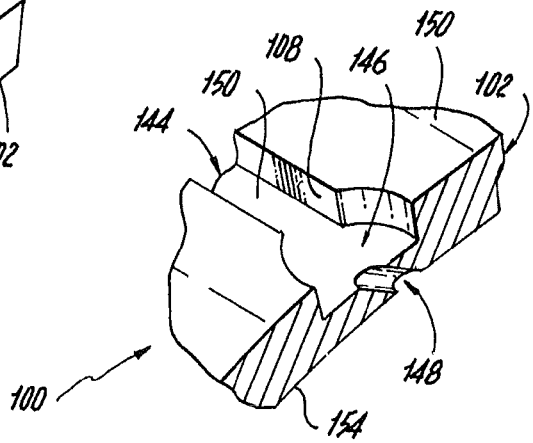

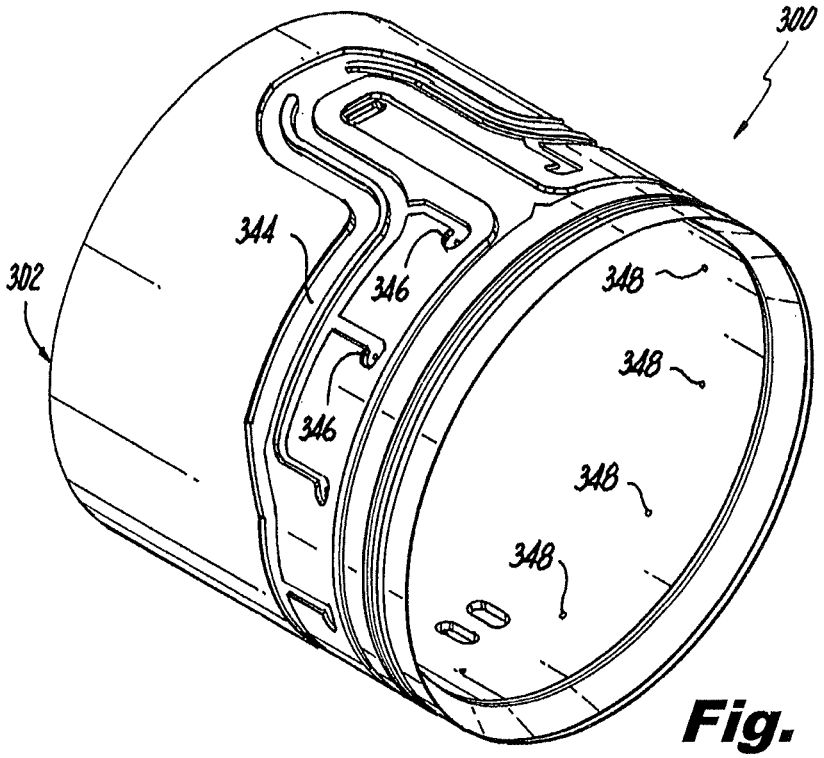
Fig. 13
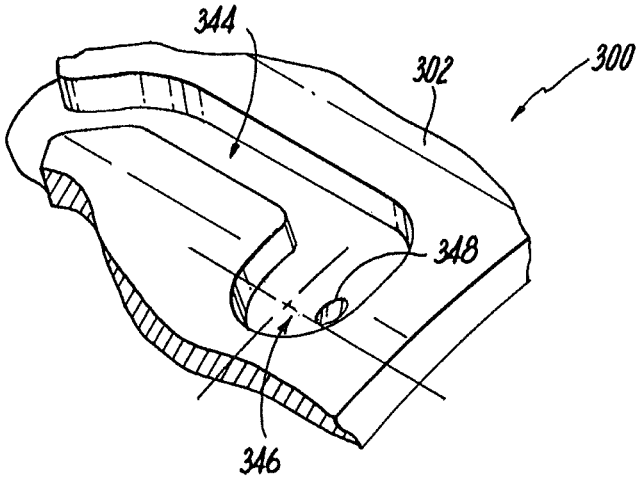
Fig. 14
Fig. 15
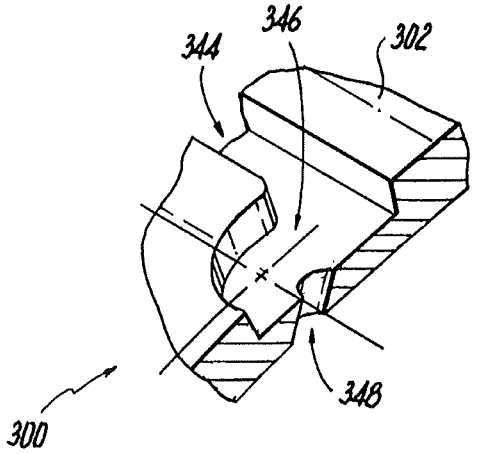

LIQUID SWIRLER FLOW CONTROL

CROSS-REFERENCE TO RELATED APPLICATIONS

This application is a continuation in part of U.S. patent application Ser. No. 13/368,659. This application is also a continuation in part of U.S. patent application Ser. No. 12/932,958. Each of the foregoing applications is incorporated by reference herein in its entirety.

BACKGROUND OF THE INVENTION

1. Field of the Invention

The present invention relates to flow control in liquid swirlers, and more particularly to control of swirl magnitude and direction in flow passages of swirlers, such as in injectors for gas turbine engines.

2. Description of Related Art

Fuel injectors for applications such as gas turbine engines require control over the distribution of the fuel through the injector. Typically fuel is introduced through a single inlet fitting, and then distributed to a plurality of fuel ports, which can be slots or drilled holes, for presentation to a swirl chamber and/or a combustion chamber. The fluid pathway from the single inlet to the plurality of ports can take many different forms. In one example, pre-swirl distribution troughs are provided upstream of the fuel ports whereby the fuel exits the inlet fitting region through one or more passages that impart a tangential velocity component to the fuel. These distribution troughs provide a space to balance the fuel distribution prior to entering the fuel ports. An example of this type of swirler is shown and described in U.S. Pat. No. 7,506,510, which is incorporated herein in its entirety. Another example provides a first full annular region separated from a second full annular region by a restrictive full annular throat region. By taking a pressure drop through the throat feature, the flow is balanced around the circumference of the component prior to the fuel entering the ports. Another example divides the fuel from the fuel inlet region into two or more discrete fuel passages with each passage terminating with one or more fuel ports, as shown and described in commonly owned, co-pending U.S. patent application Ser. No. 12/932,958. The ultimate extension of this concept has one fuel port for each passage.

The fuel-delivery path leading up to the port contributes to the character of the flow entering the port. For a port which breaks out on the inner or outer diameter of the fuel passage, the direction of the flow as it approaches the port typically has a strong component which is perpendicular to the axis of the port. In this situation, the flow will have a clear tendency to swirl as it enters the port, similar to the way water swirls as it flows down a drain. Unless proper control is in effect on the fuel as it approaches the port, the fuel may spin in either the clockwise or counter-clockwise direction. The clockwise/counter-clockwise direction of swirl can result in different behavior of the flow through and exiting the port.

The required driving pressure needed to maintain a specified flow-rate is also affected by whether the flow is swirling, and to what extent. A larger pressure-drop occurs through a hole that has a highly swirling flow therein, as opposed to a non-swirling flow. Therefore a highly swirling flow within a swirl port will require a larger driving pressure to achieve a specified flow rate, when compared to a lower or non-swirling flow.

Such conventional methods and systems have generally been considered satisfactory for their intended purpose. However, there is still a need in the art for swirl flow control that allows for improved pressure drop in flow directing components. There also remains a need in the art for devices and methods to control the amount and direction of swirl in passages of flow directing components. The present invention provides a solution for these problems.

SUMMARY OF THE INVENTION

The subject invention is directed to a new and useful flow directing device for imparting swirl on a fluid. The flow directing device includes a flow directing body having a first surface and an opposed second surface. A flow channel is defined in the first surface of the flow directing body for conducting fluids flowing through the flow directing body. The flow channel includes a channel surface set in from the first surface. A swirl bore extends though the flow directing body from the channel surface to the second surface of the flow directing body at an oblique angle relative to the channel surface for imparting a tangential swirl component onto fluids flowing through the swirl bore.

In certain embodiments, the channel surface is a channel floor and the channel includes a sidewall extending from the channel floor to the first surface of the flow directing body. The swirl bore opens at a swirl bore opening within a terminus section of the flow channel. The terminus section of the flow channel can be substantially symmetrical with respect to the flow channel upstream of the terminus section, for example, the terminus section can be circular and the swirl bore opening can be defined at the center of the circular terminus section.

In accordance with certain embodiments, the swirl bore opens at a swirl bore opening within a terminus section of the flow channel, wherein the terminus section of the flow channel is asymmetrical with respect to the flow channel upstream of the terminus section to control swirl direction for fluids flowing through the swirl bore. For example, the terminus section of the flow channel can define a dogleg with respect to the flow channel upstream of the terminus section. The dogleg can be angled to impart counter-clockwise swirl in the swirl bore as viewed towards the channel floor, or can be angled to impart clockwise swirl in the swirl bore as viewed towards the channel floor. The dogleg can be angled at about 90° relative to the flow channel upstream of the dogleg. It is also contemplated that the dogleg can be angled at any suitable angle relative to the upstream flow channel, including obliquely. For example, the angle can be between 0° and 180°, or any other suitable angle.

The swirl bore can be cylindrical, defining a swirl bore radius. The terminus section can define a semi-circular pad in the channel floor having a radius between about two to about five times the swirl bore radius. The flow channel upstream of the dogleg defines a first axis, the dogleg can define a second axis angled relative to the first axis. The swirl bore opening in the channel floor can have a center that is offset from a radial center point defined by the semi-circular pad in a direction perpendicular to the second axis. This offset can be from about one swirl bore radius to about two times the swirl bore radius. It is also contemplated that in certain embodiments, this offset can be zero or more times the swirl bore radius downstream relative to the flow channel. The center of the swirl bore opening in the channel floor can be offset from the radial center point defined by the semi-circular pad in a direction along a second axis that is angled to the first axis by about one swirl bore radius or less.

The invention also provides an injector for producing an atomized spray of liquid. The injector includes an annular injector body. An annular first flow directing body is mounted inboard of the injector body, the first flow directing body including an inboard surface and opposed outboard surface. A plurality of flow channels, as described above, are defined in the outboard surface of the first flow directing body with swirl bores for conducting fluids flowing through the first flow directing body. An annular second flow directing body is mounted radially inboard of the first flow directing body. The second flow directing body includes an outboard surface with an annular swirl chamber defined therein for receiving liquid from the swirl bores of the first flow directing body to form a swirling sheet of liquid for atomization downstream of the second flow directing body. It is also contemplated that the flow directing bodies can be configured to form a discrete jet spray for suitable applications.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 4 is a perspective view of an exemplary embodiment of a flow directing device constructed in accordance with the present invention, showing fuel channels defined in a radially outboard surface of an injector ring;

FIG. 5 is a cut-away perspective view of a portion of the flow directing device of FIG. 4, showing a terminus of one of the flow channels with a symmetrical, circular pad surrounding a swirl bore outlet;

FIG. 6 is a cut-away perspective view of a portion of the flow directing device of FIG. 4, showing the angle of the swirl bore in cross-section;

FIGS. 13, 14, and 15 are perspective views of another exemplary embodiment of a flow directing device constructed in accordance with the present invention, much like that of FIGS. 7, 11, and 12, respectively, but with channel terminus portions having doglegs in the opposite direction for creating swirl in the opposite direction;

DETAILED DESCRIPTION OF THE PREFERRED EMBODIMENTS

Figure 1:
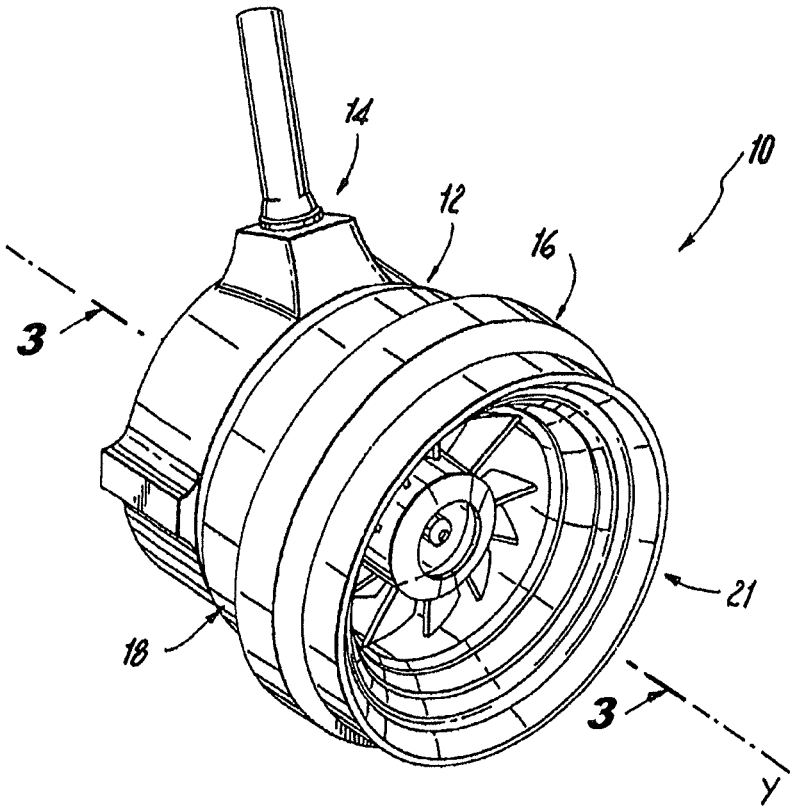
FIG. 1 is a perspective view of an exemplary embodiment of a staged fuel injector constructed in accordance with the present invention, showing the spray outlet.

Reference will now be made to the drawings wherein like reference numerals identify similar structural features or aspects of the subject invention. For purposes of explanation and illustration, and not limitation, a partial view of an exemplary embodiment of a flow directing device in accordance with the invention is shown in FIG. 4 and is designated generally by reference character 100. Other embodiments of flow directing devices in accordance with the invention, or aspects thereof, are provided in FIGS. 1-3 and 5-20, as will be described. The system of the invention can be used to control swirl, for example, in fuel swirlers for gas turbine engines.

Referring now to FIG. 1, fuel injector 10 is adapted and configured for producing an atomized spray of liquid, such as for delivering fuel to the combustion chamber of a gas turbine engine. Fuel injector 10 is generally referred to as a staged fuel injector in that it includes a pilot fuel circuit, which typically operates during engine ignition and at low engine power and a main fuel circuit, which typically operates at high engine power (e.g., at take-off and cruise) and is typically staged off at lower power operation.

Figure 3:
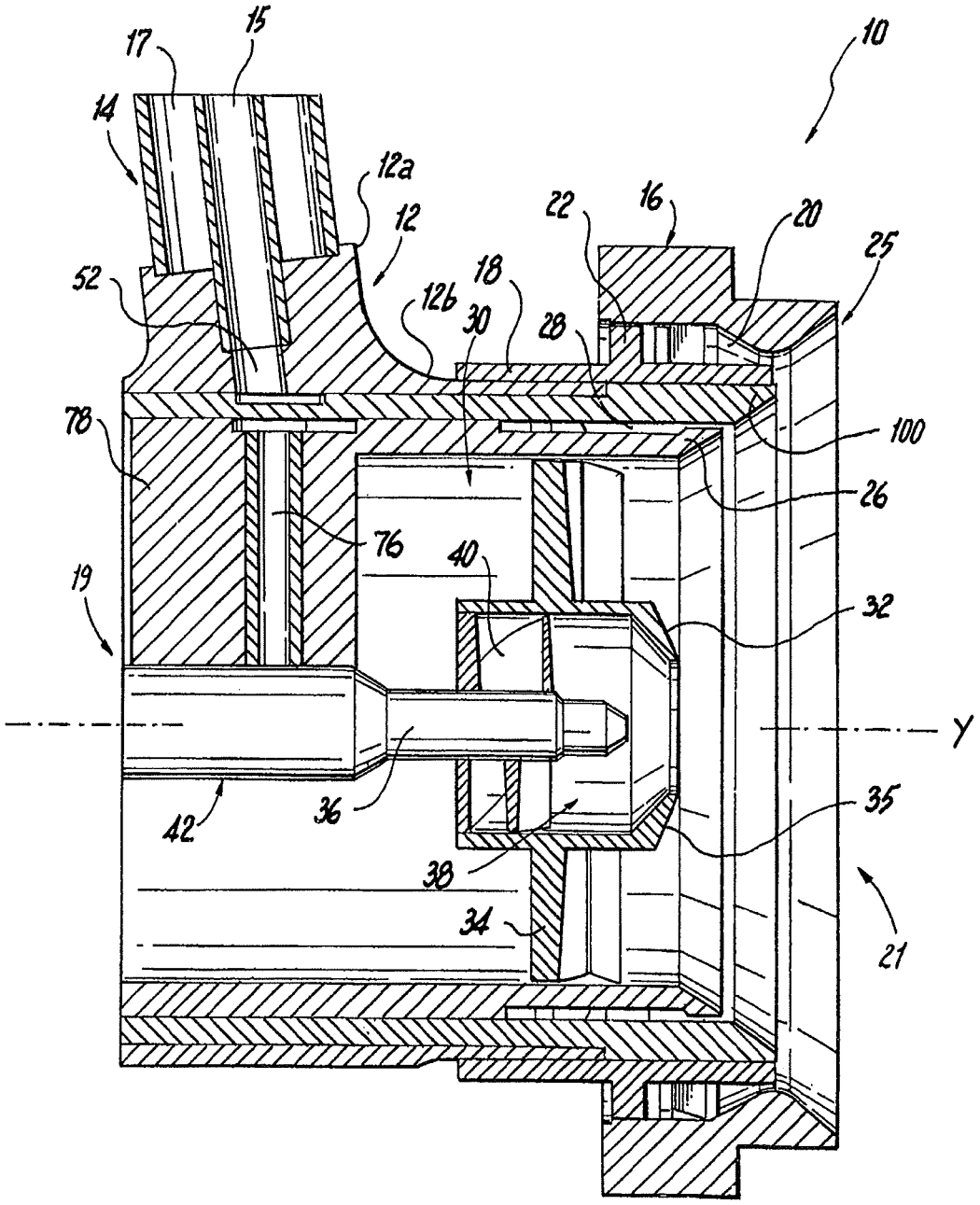
FIG. 3 is a cross-sectional side elevation view of the injector of FIG. 1, showing the fuel and air circuits for the main and pilot fuel stages.

Fuel injector 10 includes a generally annular injector body 12, which depends from an elongated feed arm 14, and defines a longitudinal axis y. In operation, main and pilot fuel flows are delivered into injector body 12 through concentric fuel feed tubes. As shown in FIG. 3, these feed tubes include an inner/main fuel feed tube 15 and an outer/pilot fuel feed tube 17 located within the feed arm 14. Although not depicted herein, it is envisioned that the fuel feed tubes could be enclosed within an elongated shroud or protective strut extending from a fuel fitting to the nozzle body.

Figure 2:
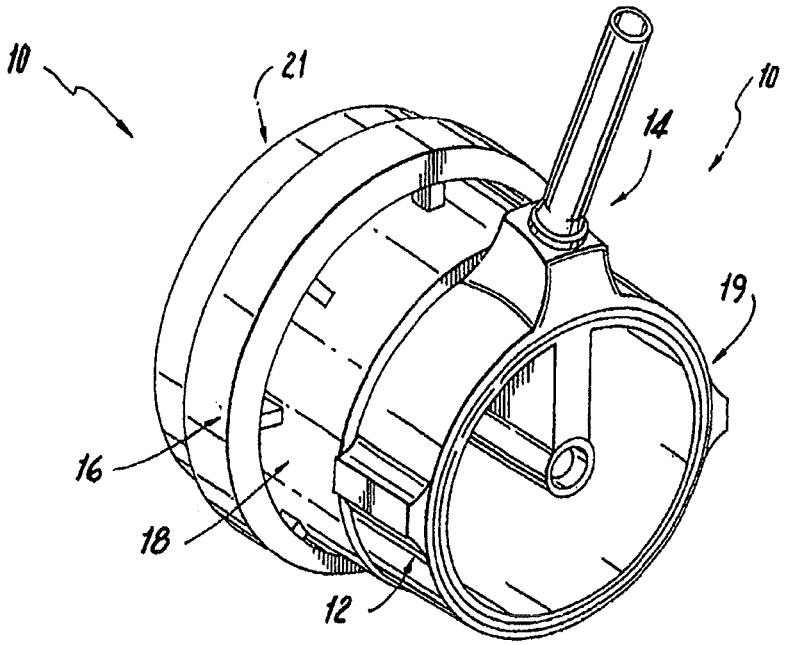
FIG. 2 is a perspective view of the injector of FIG. 1, showing the air inlet end portion of the injector.

Referring now to FIG. 2, at the same time fuel is delivered to injector body 12 through feed arm 14, pressurized combustor discharge air is directed into the inlet end 19 of injector body 12 and directed through a series of main and pilot air circuits or passages, which are shown in FIG. 3. The air flowing through the main and pilot air circuits interacts with the main and pilot fuel flows from feed arm 14. That interaction facilitates the atomization of the main and pilot fuel issued from the outlet end 21 of injector body 12 and into the combustion chamber of the gas turbine engine.

Referring now to FIG. 3, injector body 12 includes a main fuel atomizer 25 that has an outer air cap 16 and a main outer air swirler 18. A main outer air circuit 20 is defined between the outer air cap 16 and the outer air swirler 18. Swirl vanes 22 are provided within the main outer air circuit 20, depending from outer air swirler 18, to impart an angular component of swirl to the pressurized combustor air flowing therethrough.

Fuel injector 10 includes a flow directing body 100 mounted inboard of injector body 12, positioned radially inward of the outer air swirler 18. In this position, flow directing body 100 takes the place of a traditional prefilmer. A second flow directing device 26, in the place of a traditional annular main fuel swirler, is mounted radially inward of the flow directing body 100. Flow directing body 100 has a diverging prefilming surface at the nozzle opening. As described in more detail herein below with reference to FIGS. 4 and 5, portions of the fuel circuits, including flow channels and respective swirl ports are defined in the outer diametrical surface of the flow directing device 100 for conducting fluids flowing therethrough.

With continuing reference to FIG. 3, the main fuel circuit receives fuel from the inner feed tube 15 and delivers that fuel into an annular swirl chamber 28 defined in the outboard surface of second flow directing device 26 and located at the outlet end of the main fuel atomizer 25. Swirl chamber 28 receives liquid from swirl ports of flow directing device 100, which are described below, to form a swirling sheet of liquid for atomization downstream of flow directing device 100. It is also contemplated that the flow directing device can be configured to form a discrete jet spray for suitable applications. The main fuel atomizer further includes a main inner air circuit 30 defined between the second flow directing device 26 and a converging pilot air cap 32. Swirl vanes 34 are provided within main inner air circuit 30, depending from pilot air cap 32, to impart an angular component of swirl to the pressurized combustor air flowing therethrough. In operation, swirling air flowing from main outer air circuit 20 and main inner air circuit 30 impinge upon the fuel issuing from swirl chamber 28, to promote atomization of the fuel.

Injector body 12 further includes an axially located pilot fuel atomizer 35 that includes the converging pilot air cap 32 and a pilot outer air swirler 36. A pilot outer air circuit 38 is defined between pilot air cap 32 and pilot outer air swirler 36. Swirl vanes 40 are provided within pilot outer air circuit 38, depending from air swirler 36, to impart an angular component of swirl to the air flowing therethrough. A pilot fuel swirler 42, shown here by way of example, as a pressure swirl atomizer, is coaxially disposed within the pilot outer air swirler 36. The pilot fuel swirler 42 receives fuel from the pilot fuel circuit by way of the inner pilot fuel conduit 76 in support flange 78. Pilot fuel conduit 76 is oriented radially, or perpendicularly with respect to longitudinal axis y.

Injector body 12 includes a tube mounting section 12*a* and an atomizer mounting section 12*b* of reduced outer diameter. Tube mounting section 12*a* includes radially projecting mounting appendage that defines a primary fuel bowl for receiving concentric fuel tubes 15 and 17 of feed arm 14. A central main bore 52 extends from the fuel bowl for communicating with inner/main fuel tube 15 to deliver fuel to the main fuel circuit. Dual pilot fuel bores communicate with and extend from the fuel bowl for delivering pilot/cooling fuel from outer/pilot fuel tube 17 to the pilot fuel circuit.

With reference now to FIG. 4, flow directing device 100 for imparting swirl on a fluid includes a flow directing body 102 having a first surface, i.e., outboard surface 156, and opposed second surface, i.e., inboard surface 154. Flow directing body 100 is an annular ring, configured for use in place of a prefilmer/fuel swirler in a fuel injector as described above. A set of branching flow channels 144 is defined in outboard surface 156 for conducting fluids flowing through flow directing body 102.

Referring now to FIG. 5, one of the flow channels 144 is described in greater detail. Each of the flow channels 144 includes a channel surface, namely channel floor 150, and a sidewall 108 extending from channel floor 150 to outboard surface 156. A swirl bore 148 extends though flow directing body 102 from channel floor 150 to inboard surface 154 of the flow directing body 102 at an oblique angle relative to channel floor 150 for imparting a tangential swirl component onto fluids flowing through swirl bore 148. In FIG. 6, the angle of swirl bore 148 relative to channel floor 150 is shown in cross-section. Swirl bore 148 is cylindrical, with the axis of the cylinder being angled tangentially with respect to axis y, shown in FIG. 4, rather than being aligned with a radius extending from axis y. The swirl bores 148 can be formed by drilling, electrical discharge machining, or any other suitable process. Due to its angle relative to channel floor 150, the opening of swirl bore 148 in channel floor 150 is an ellipse, the minor radius of which is equal in length to the radius of the cylinder defined by swirl bore 148. As shown in FIG. 4, the plurality of swirl bores 148 in flow directing body 102 are circumferentially spaced apart for imparting swirl on a bulk flow of liquid entering the fuel channels 144 and passing through flow directing body 102 in a generally inward direction through bores 148. In FIG. 4, the swirl bores 148 are evenly spaced circumferentially, however the spacing can be uneven in suitable applications.

With continued reference to FIGS. 5 and 6, each swirl bore 148 opens at a swirl bore opening within a terminus section 146 of the respective flow channel 144. Terminus section 146 is generally symmetrical with respect to the portion of flow channel 144 just upstream of terminus section 146. More particularly, terminus section 146 is circular and the opening of swirl bore 148 in channel floor 150 is at the center of the circular terminus section 146. As liquid flows along channel 144, the conditions upstream of bore 148 impart swirl on the flow as it enters terminus section 146 and passes into bore 148. It has been found that this type of symmetrical terminus section can lead to lack of control of the direction of swirl of flow within the terminus section, be it clockwise or counterclockwise as viewed in FIG. 5. In certain applications this can result in unequal pressure losses distributed among the ports, leading to increased flow non-uniformity, for example when the flow from multiple swirl bores 148 produces conflicting swirl directions within a single flow directing device 100.

Figure 7:
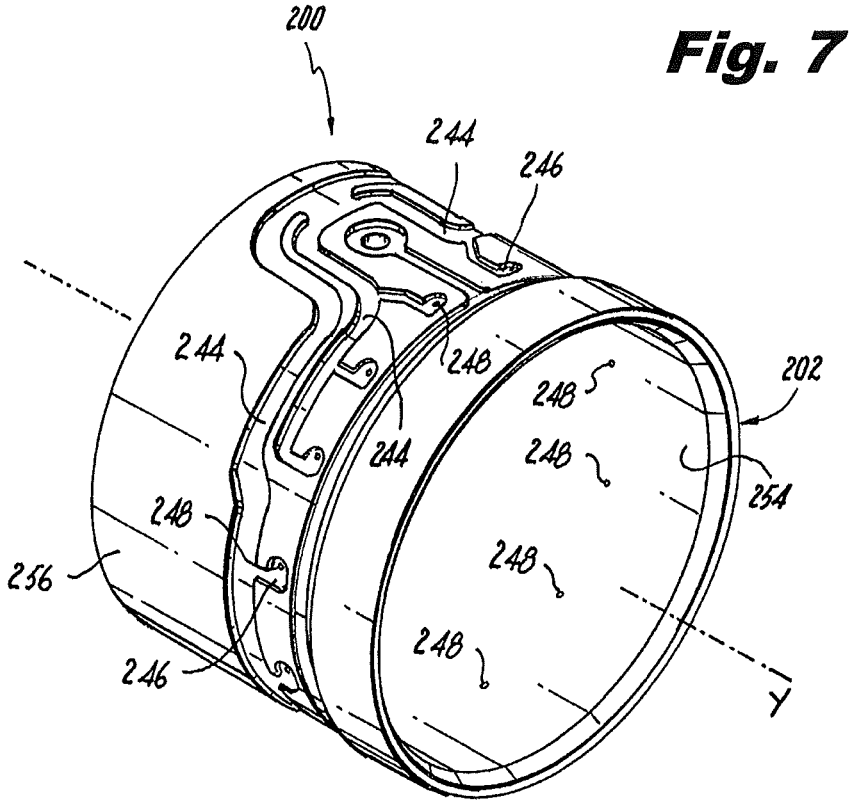
FIG. 7 is a perspective view of another exemplary embodiment of a flow directing device constructed in accordance with the present invention, showing the channels having asymmetrical terminus portions.
Figure 8:
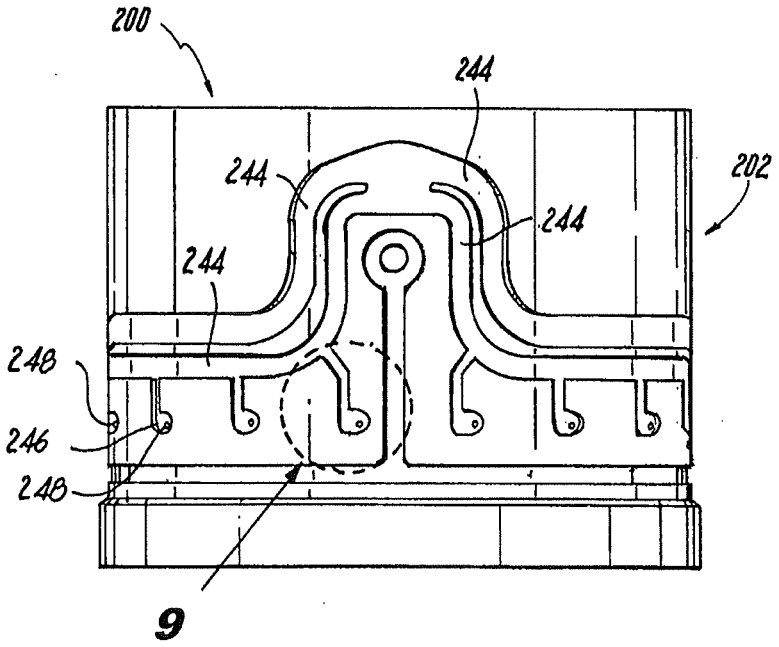
FIG. 8 is a plan view of the flow directing device of FIG. 7, showing the terminus portions of individual channels.
Figure 9:
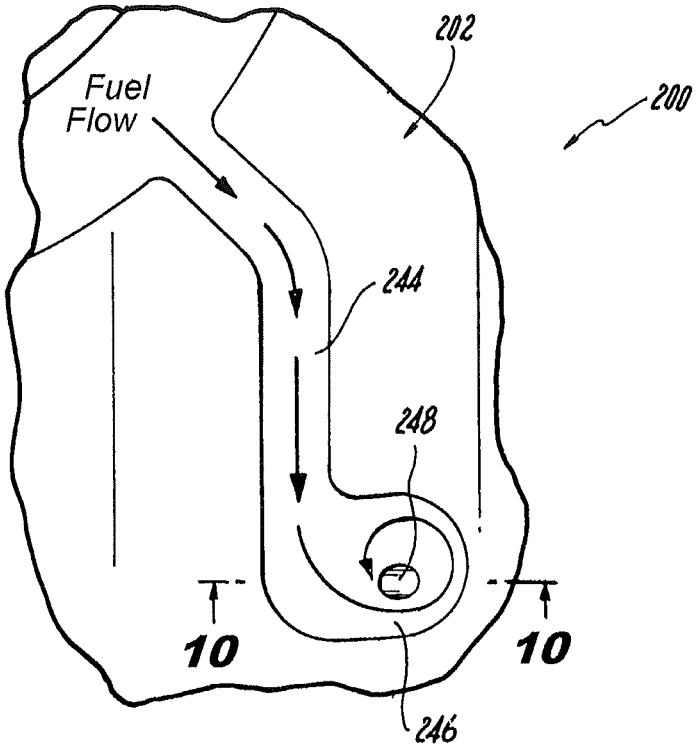
FIG. 9 is a plan view of a portion of the flow directing device of FIG. 8, schematically showing a flow of fuel through the channel exiting the swirl bore in the channel floor.
Figure 10:
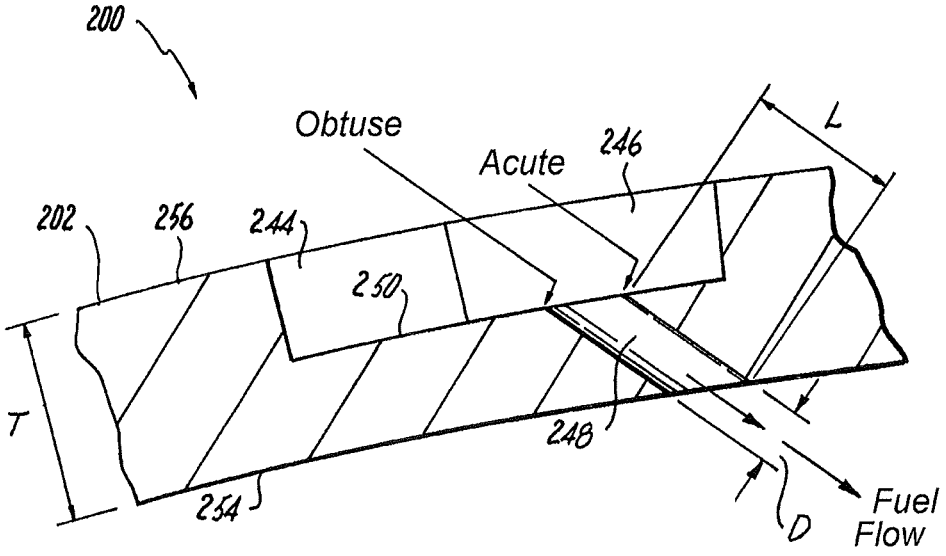
FIG. 10 is a cross-sectional end view of a portion of the flow directing device of FIG. 9, showing the swirl bore passing through the flow directing device from the channel floor to the inner surface of the of the flow directing device.

Referring now to FIG. 7, another exemplary embodiment of a flow directing device 200 is described, which allows for control of the direction of swirl in each channel terminus. Branching fuel channels 244 end in a plurality of terminus portions 246, each having a swirl bore 248 that is angled tangentially as described above. Flow directing body 202 includes an inboard surface 254 and opposed outboard surface 256. Channels 244 are formed in outboard surface 256, and the swirl bores 248 extend from channel floor 250 through flow directing body 202 to inboard surface 254, as shown in FIG. 10. Terminus portions 246 each have a dogleg to the right relative to the portion of channel 244 immediately upstream of terminus section 246, as oriented in FIG. 8. FIG. 9 shows an enlarged view of one of the terminus portions 246 of the channel 244 indicated in FIG. 8. As indicated in FIG. 9, as fuel passes through flow directing body 202 by way of swirl bore 248, a tangential component is imparted on the flow direction that causes a swirling flow around the volume within an inboard swirl chamber such as that shown and described in the applications incorporated by reference above. The importance of orienting swirl bores 248 in a predominantly tangential direction is to impart sufficient swirl to the liquid to enhance the mixing of the discrete fuel streams from the individual swirl bores 248 within a common swirl chamber. The enhanced mixing of the fuel streams ensures that the fuel will form a coherent sheet of liquid upon exiting the swirl chamber, and improve the circumferential uniformity of the fuel sheet for a well distributed spray of atomized fuel.

Referring again to FIG. 9, one characteristic of the swirl bore configuration in flow directing device 200 is the tendency for a swirling flow to form within the terminus portion 246, much as in the drain-type swirl effect described above. The liquid delivery path leading up to swirl bore 248 contributes to the character of the flow entering swirl bore 248. For a bore originating on the outer diameter of a flow passage, the direction of the flow as it approaches the bore typically has a strong component which is perpendicular to the axis of the bore, and the same can be said for bores originating on an inner diameter surface. In this situation, the flow will have a clear tendency to swirl as it enters the bore, similar to the way water swirls as it flows down a drain. Unless proper control is effected on the liquid as it approaches the bore, the liquid may spin in either a clockwise or counter-clockwise direction, which can result in different behavior of the flow through and exiting the bore. Therefore, it is advantageous to control the direction of swirl as it enters the bores.

Figure 11:
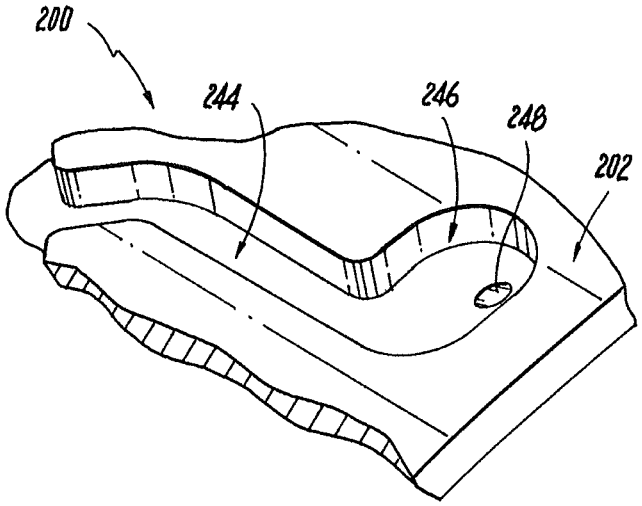
FIG. 11 is a cut-away perspective view of the fuel channel of FIG. 9, showing the swirl bore.
Figure 12:
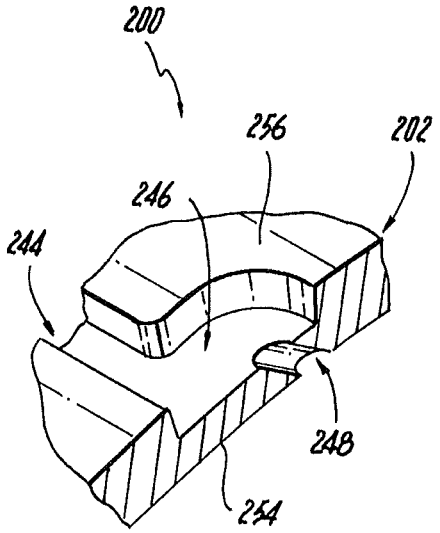
FIG. 12 is a cut-away perspective view of the fuel channel of FIG. 11, showing the angle of the swirl bore relative to the channel floor in cross-section.

This swirling flow entering swirl bore 248 is indicated schematically by the flow arrows of FIG. 9. FIGS. 11 and 12 show the asymmetry of terminus section 246 and bore 248 for direct comparison with FIGS. 5 and 6, respectively. Unlike the symmetrical terminus sections 146 described above, in which the swirl direction varies depending on upstream conditions, the dogleg of terminus section 246 forces the counter-clockwise swirl direction indicated in FIG. 9. Since each terminus section 246 around flow directing body 202 has the same dogleg direction, each terminus section 246 has the same swirl direction relative to its respective swirl bore 248. This common, controlled swirl direction is in contrast to the swirl directions of flow directing body 102 described above, which vary from channel to channel. Having consistent swirl directions for each of the swirl bores 248 improves pressure drop, fuel distribution, and the strength of the desirable swirl around annular swirl chamber 28 described above.

As indicted in FIG. 10, due to the oblique angle of swirl bore 248 relative to floor 250 of channel 244, a portion of the swirl bore opening forms an acute angle with floor 250, and a portion forms an obtuse angle therewith. Due to process variation, the characteristics of this entrance can vary from one swirl bore 248 to another around the circumference of prefilmer 224. Care should be exercised to ensure appropriate levels of process variation sensitivity in forming the swirl bores for given applications. If there is significant process variation sensitivity in a given application, mitigation measures are described in U.S. patent application Ser. No. 13/368,659. Moreover, each swirl bore 248 has a length L and diameter D. The effectiveness at generating the desirable tangential swirl component on liquids flowing through swirl bore 248 is a function of the L/D ratio, the higher the ratio, the more effective the swirl bore. The thickness T of flow directing body 202 and the depth of channel 244 can be adjusted as needed to provide an appropriate L/D ratio for a given application.

Figure 20:
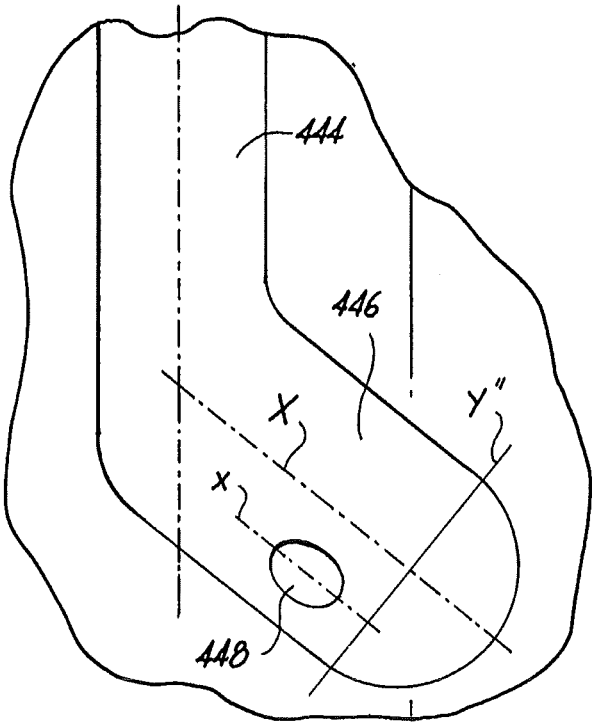
FIG. 20 is a schematic plan view of the channel terminus of FIG. 18, showing the offset of the swirl bore opening in the channel floor relative to the oblique channel terminus.

With reference now to FIGS. 13-15, another exemplary embodiment of a flow directing device 300 is shown with a flow directing body 302, branching flow channels 344, and swirl bores 348 similar to those described above. As can be seen by comparison of FIGS. 13, 14, and 15 with FIGS. 7, 11, and 12, respectively, terminus sections 346 are similar to terminus sections 246 described above, but the dogleg direction is opposite. This means that whereas terminus sections 246 described above induce a counter-clockwise swirl as viewed in FIG. 9, terminus sections 346 induce a clockwise swirl entering swirl bores 348. While the terminus sections 246 and 346 described above both have dogleg angles of 90° relative to the flow channel 244/344 just upstream of the dogleg, other dogleg angles can be used without departing from the spirit and scope of the invention. For example, FIGS. 18 and 19, which can be compared to FIGS. 11 and 12, respectively, show an exemplary channel 444 having a terminus section 446 with a dogleg angle $\alpha$ of about 45° relative to the portion of channel 444 just upstream of terminus 446. Swirl bore 448 defines a compound angle, having a tangential component as described above plus an axial component that is aligned with the angle $\alpha$ shown in FIG. 18 so the axis X of terminus section 446 and the axis x of swirl bore 448 are aligned parallel to one another in plan view as shown in FIG. 20. The uses and advantages of such compound angles for swirl bores are described in greater detail in U.S. patent application Ser. No. 13/368,659. Examples have been given above for dogleg angles of 90° and 45°. It is contemplated that any suitable dogleg angle can be used without departing from the spirit and scope of the invention, and that angles from 0° to 180° are particularly suitable for fuel injection applications, for example. Without wishing to be bound to theory, turning angles larger than 180° can also provide proper control of swirl direction in accordance with the invention, but may result in overly-complicated flow pathways, excessive machining, and difficulties maintaining other design constraints such as envelope, cost, and weight limitations.

Figure 16:
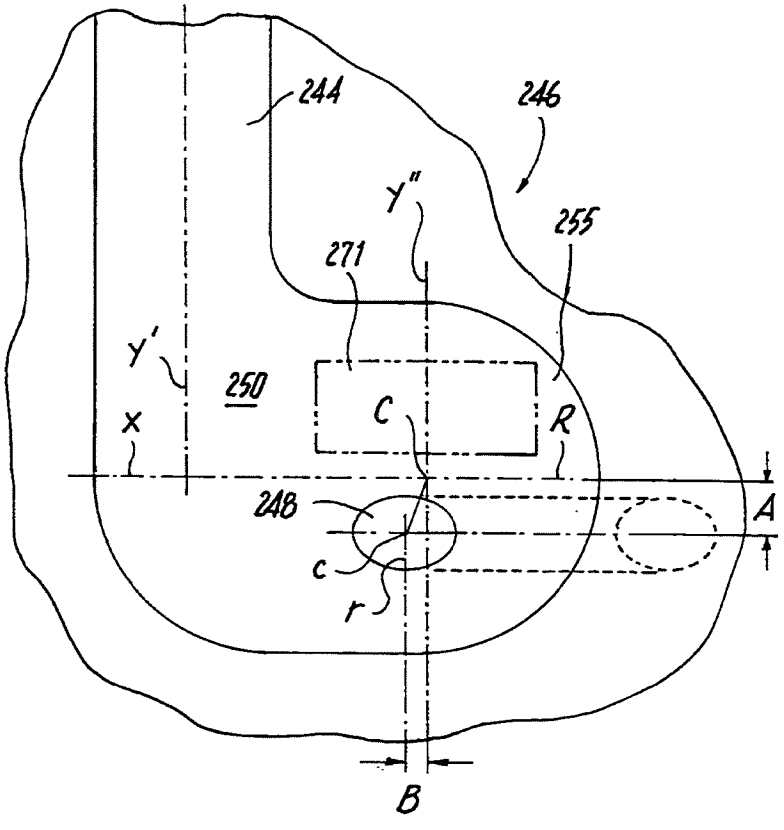
FIG. 16 is a schematic plan view of the channel terminus of FIG. 9, showing the offset of the swirl bore opening in the channel floor relative to the channel terminus.
Figure 18:
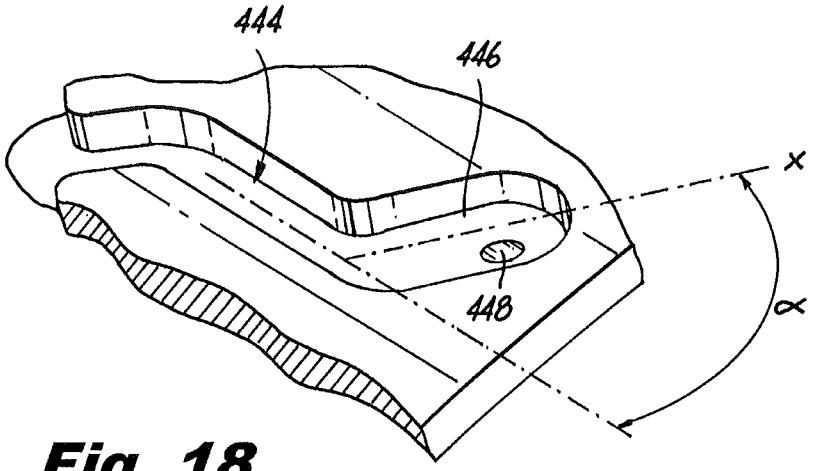
FIG. 18 is a perspective view of a portion of another exemplary embodiment of a flow directing device constructed in accordance with the present invention, showing a channel terminus that is angled obliquely relative to the channel upstream of the terminus.
Figure 19:
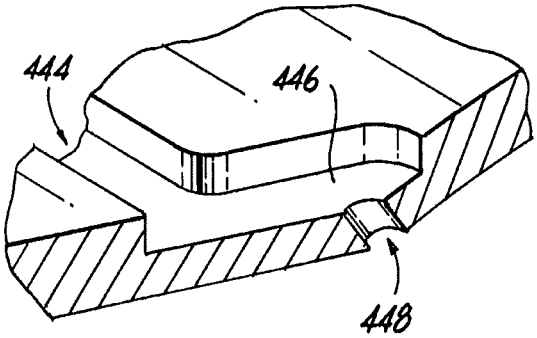
FIG. 19 is a cut-away perspective view of the channel terminus of FIG. 18, showing the alignment of the swirl bore and the channel terminus.

Referring now to FIG. 16, when swirl forms in a channel terminus such as those described above, the swirl raises pressure drop and reduces the flow number for the swirl bore compared to what the flow would be like with no swirl. In most applications it is desirable to mitigate this type of swirl. The location of swirl bore 248 within terminus section 246 affects the amount of swirl induced on flow passing into swirl bore 248.

Terminus section 246 of channel 244 defines a semi-circular pad 255 in the channel floor 250 having a radius R that is about 4.5 times the radius r of swirl bore 248. The semi-circular pad 255 could be any size with a radius R between about 2.0 to about 5.0 times the swirl bore radius r while still attaining the benefits described above. Pad 255, and teiminus section 246 in general, should be of sufficient size relative to the respective swirl bore, so that the swirl bore can be placed for controlling the amount of flow through the swirl bore for a given driving pressure.

The flow channel upstream of the dogleg defines a first axis y', which is parallel to axis y in FIG. 7. Semi-circular pad 255 defines a radial center point C. Axis y" runs parallel to axis y' through center point C. The opening of swirl bore 248 in channel floor 250 has a center c that is offset from center point C in a direction parallel to axis y" (i.e. in a direction perpendicular to axis X). This offset is represented in FIG. 16 by distance A. This offset distance A is shown in FIG. 16 as about 1.5 times radius r, and in FIG. 17 as about 1.0 times radius r. However, offset distance A can be anything from about 1.0 times radius r to about 2.0 times radius r below center point C as oriented in FIGS. 16-17. In certain applications, offset distance A can be zero, i.e., swirl bore 248 can be centered vertically on axis X. If the dogleg axis, axis X, is oblique relative to the first axis y', as in FIG. 20, then the offset distance A is perpendicular to the oblique axis X.

Figure 17:
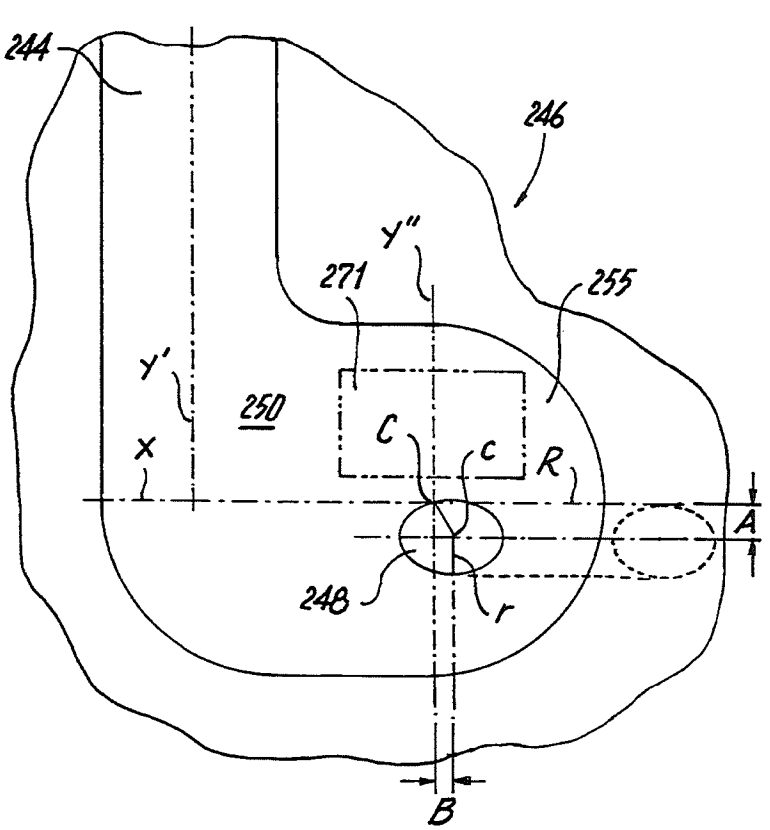
FIG. 17 is a schematic plan view of the channel terminus of FIG. 16, showing another exemplary position for the swirl bore.

With continued reference to FIGS. 16-17, an axis X is defined perpendicular to axis y" along channel floor 250 through center point C. Swirl bore opening center c is also offset from center point C in a direction parallel to axis X, which offset is represented by distance B in FIGS. 16-17. In FIG. 16, offset distance B is about 0.75 times radius r towards axis y', and in FIG. 17, offset distance B is about 0.5 times radius r away from axis y'. However, offset distance B can be anything from about 1.0 times radius r to the left of center point C to about 1.0 times radius r to the right of center point C, as oriented in FIGS. 16-17. If the axis X is oblique relative to first axis y', as in FIG. 20, then the offset distance B is parallel to the oblique axis X.

It has been determined, in conjunction with the subject invention, that region 271 that is depicted in FIGS. 16-17 as a generally rectangular area, is a location where swirl is intensified if a swirl bore is located therein. Locating the center of a swirl port in region 271 results in higher driving pressure for a given flow-rate, as well as increased unsteadiness. Swirl port region 271 is generally the area just above the X axis, centered on the y" axis, and about one radius R wide as oriented in FIGS. 16-17. In the case of an oblique dogleg, as in FIGS. 18-20, the position of swirl bore 448 can be set using the principles outlined above, wherein the X and y" axes are oriented based on the orientation of terminus section 446, as shown in FIG. 20.

While described above in the exemplary context of annular directing flow within fuel injectors, those skilled in the art will readily appreciate that flow directing devices in accordance with the invention can be used in any suitable application, and need not be annular. Directing the flow from an outboard surface through swirl bores to an inboard surface is exemplary, as it is contemplated that flow directing devices in accordance with the invention can direct flow from a radially inner surface out to a radially outboard surface as well. The exemplary embodiments above have channel floors and channel walls, however those skilled in the art will readily appreciate that any suitable channel surface arrangement can be used, for example, a single curved surface can define a channel, without departing from the spirit and scope of the invention. Moreover, while described in the exemplary context of liquid fuel, any suitable fluid can be used without departing from the spirit and scope of the invention.

The methods and systems of the present invention, as described above and shown in the drawings, provide for swirler flow control devices and methods with superior properties including improved pressure drop and improved control of swirl direction and intensity. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. An injector for producing an atomized spray of liquid comprising:

a) an annular injector body;

b) an annular first flow directing body mounted inboard of the injector body, the first flow directing body including an inboard surface and opposed outboard surface, wherein a plurality of flow channels are defined in the outboard surface of the first flow directing body for conducting fluids flowing through the first flow directing body, wherein each flow channel includes a channel floor and a sidewall extending from the channel floor to the outboard surface of the first flow directing body, and wherein a swirl bore extends through the first flow directing body from each channel floor to the inboard surface of the first flow directing body at an oblique angle relative to the channel floor for imparting a tangential swirl component onto fluids flowing through the swirl bore; and c) an annular second flow directing body mounted radially inboard of the first flow directing body and including an outboard surface with an annular swirl chamber defined therein for receiving liquid from the swirl bores of the first flow directing body to form a swirling sheet of liquid for atomization downstream of the second flow directing body;

wherein a terminus section of each flow channel defines a dogleg with respect to the flow channel upstream of the terminus section;

wherein the dogleg is angled relative to the flow channel upstream of the dogleg;

wherein the swirl bore of each flow channel defines a swirl bore radius, wherein the terminus section of each flow channel defines a semi-circular pad in the channel floor having a radius between about two to about five times the swirl bore radius.

2. The injector as recited in claim 1, wherein the flow channel upstream of each dogleg defines a respective first axis, wherein each respective dogleg defines a second axis angled relative to the first axis, and wherein the swirl bore opening in each channel floor has a center that is offset from a radial center point defined by the semi-circular pad in a direction perpendicular to the second axis by about one swirl bore radius or more and about two times the swirl bore radius or less.

3. The injector as recited in claim 1, wherein the flow channel upstream of each dogleg defines a respective first axis, wherein each respective dogleg defines a second axis angled relative to the first axis, and wherein the swirl bore opening in each channel floor has a center that is offset from a radial center point defined by the semi-circular pad in a direction perpendicular to the second axis by zero or more times the swirl bore radius downstream relative to the flow channel.

4. The injector as recited in claim 1, wherein the flow channel upstream of each dogleg defines a respective first axis, and wherein the swirl bore opening in each channel floor has a center that is offset from a radial center point defined by the semi-circular pad in a direction along a second axis that is angled relative to the first axis by about one swirl bore radius or less.

* * * * *